US009027258B2

(12) United States Patent
Bellinger et al.

(10) Patent No.: US 9,027,258 B2
(45) **Date of Patent: *May 12, 2015**

(54) LAUNDRY TREATING APPLIANCE WITH CONTROLLED CYCLE TIME

(75) Inventors: Ryan R. Bellinger, Saint Joseph, MI (US); David J. Kmet, Paw Paw, MI (US); Scott D. Parde, Portage, MI (US); Michele A. Paustian, Kalamazoo, MI (US); Joseph M. Shaw, Niles, MI (US); David M. Williams, Saint Jospeh, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1239 days.

This patent is subject to a terminal disclaimer.

(21) Appl. No.: 12/909,153

(22) Filed: Oct. 21, 2010

(65) Prior Publication Data

US 2012/0096736 A1 Apr. 26, 2012

(51) Int. Cl.
*D06F 58/28* (2006.01)
*D06F 58/02* (2006.01)

(52) U.S. Cl.
CPC ..... *D06F 58/28* (2013.01); *D06F 58/02* (2013.01); *D06F 2058/2854* (2013.01); *D06F 2058/289* (2013.01); *D06F 2058/2896* (2013.01)

(58) Field of Classification Search
CPC ..... D06F 58/28; D06F 2058/28; D06F 2058/2854; D06F 2058/2858; D06F 2058/2883; D06F 2058/289; D06F 2058/2896; D06F 58/02; D06F 58/20
USPC ..... 34/282, 491, 524, 549, 595
See application file for complete search history.

(56) References Cited

U.S. PATENT DOCUMENTS

| | | | |
|---|---|---|---|
| 4,158,431 | A | 6/1979 | Van Bavel et al. |
| 4,245,309 | A | 1/1981 | Kiefer |
| 4,275,464 | A | 6/1981 | Schmidt |
| 4,521,885 | A | 6/1985 | Melocik et al. |
| 4,628,443 | A | 12/1986 | Rickard et al. |
| 4,738,034 | A | 4/1988 | Muramatsu et al. |
| 4,977,394 | A | 12/1990 | Manson et al. |
| 5,051,996 | A | 9/1991 | Bergeson et al. |
| 5,079,410 | A | 1/1992 | Payne et al. |
| 5,560,124 | A | 10/1996 | Hart et al. |
| 5,923,676 | A | 7/1999 | Sunter et al. |
| 6,169,383 | B1 | 1/2001 | Johnson |
| 6,271,506 | B1 | 8/2001 | Glaser |
| 6,446,357 | B2 | 9/2002 | Woerdehoff et al. |

(Continued)

FOREIGN PATENT DOCUMENTS

| | | | |
|---|---|---|---|
| DE | 2949934 | A1 | 7/1980 |
| DE | 19939273 | A1 | 2/2001 |

(Continued)

OTHER PUBLICATIONS

German Search Report for corresponding DE102011052772, Dec. 2, 2011.

*Primary Examiner* — Jiping Lu

(57) ABSTRACT

A method of operating a clothes dryer having a treating chamber for receiving a laundry load, an air system for supplying and exhausting air from the treating chamber, a heating element for heating the air supplied to the treating chamber, and a controller implementing a cycle of operation, wherein the controller estimates a cycle time of a drying cycle of operation.

21 Claims, 4 Drawing Sheets

(56) References Cited

U.S. PATENT DOCUMENTS

| | | | | |
|---|---|---|---|---|
| 6,457,145 | B1 | 9/2002 | Holmberg et al. | |
| 6,519,871 | B2 | 2/2003 | Gardner et al. | |
| 6,763,485 | B2 | 7/2004 | Whetsel | |
| 6,845,290 | B1 * | 1/2005 | Wunderlin et al. | 34/524 |
| 6,848,140 | B2 | 2/2005 | Cho | |
| 6,995,965 | B2 * | 2/2006 | Hameed et al. | 34/595 |
| 7,108,754 | B2 * | 9/2006 | Franco et al. | 134/34 |
| 7,113,075 | B2 | 9/2006 | Odorcic et al. | |
| 7,197,429 | B2 | 3/2007 | Rosa | |
| 7,282,921 | B2 | 10/2007 | Sela et al. | |
| 7,478,486 | B2 | 1/2009 | Wunderlin et al. | |
| 7,525,317 | B2 * | 4/2009 | Yang | 324/509 |
| 7,594,343 | B2 | 9/2009 | Woerdehoff et al. | |
| 8,555,522 | B2 * | 10/2013 | Bellinger et al. | 34/549 |
| 2002/0032491 | A1 | 3/2002 | Imamura et al. | |
| 2002/0147804 | A1 | 10/2002 | Cosmao et al. | |
| 2005/0143865 | A1 * | 6/2005 | Gardner | 700/291 |
| 2007/0220907 | A1 | 9/2007 | Ehlers | |
| 2009/0172967 | A1 | 7/2009 | Son et al. | |
| 2009/0206816 | A1 | 8/2009 | Henle et al. | |
| 2009/0313848 | A1 | 12/2009 | Moschutz et al. | |
| 2010/0013491 | A1 | 1/2010 | Hooper et al. | |

FOREIGN PATENT DOCUMENTS

| | | | |
|---|---|---|---|
| DE | 102007052078 | A1 | 5/2009 |
| JP | 2006006467 | A | 1/2006 |
| KR | 19960000817 | B1 | 1/1996 |
| KR | 20050021834 | A | 3/2005 |
| KR | 10-0939716 | A | 1/2010 |
| WO | 2010/049822 | A1 | 5/2010 |

* cited by examiner

LAUNDRY TREATING APPLIANCE WITH CONTROLLED CYCLE TIME

BACKGROUND OF THE INVENTION

Contemporary laundry treating appliances, such as clothes dryers, may be provided with a treating chamber for receiving a laundry load for treatment, such as drying, and a heating element for heating the air to treat the laundry load. The laundry load may be treated in the treating chamber for a predetermined cycle time according to a cycle of operation. For some clothes dryers, the cycle time may be manually input by a user through a user interface. For other clothes dryers, one or more sensors may detect a load characteristic and set a cycle time based on the load characteristic.

SUMMARY OF THE INVENTION

A method of operating a clothes dryer by determining a voltage/wattage of a heating element, inputting the voltage/wattage to a controller, wherein the controller estimates a cycle time based on at least the inputted voltage/wattage.

DESCRIPTION OF EMBODIMENTS OF THE INVENTION

The invention is generally directed toward accurately estimating a cycle time during a drying cycle for a laundry load in a clothes dryer. The cycle time may be calculated based on a load characteristic such as load size, fabric type, moisture content, and the like. However, it has been found that such estimates of the cycle time may be inaccurate when voltage across the heating element is not considered because a change in the voltage results in a change in the wattage of the heating element. The particular approach of the invention is to determine the voltage/wattage across the heating element during the drying cycle. One contemplated method is to determine the voltage/wattage across the heating element such that a controller may calculate and update cycle time in consideration of the voltage and wattage. For purposes of this application, the terms voltage and wattage may be interchangeable because the power (wattage) of the electrical heating element is proportional to the square of the voltage across the heating element.

Figure 1:
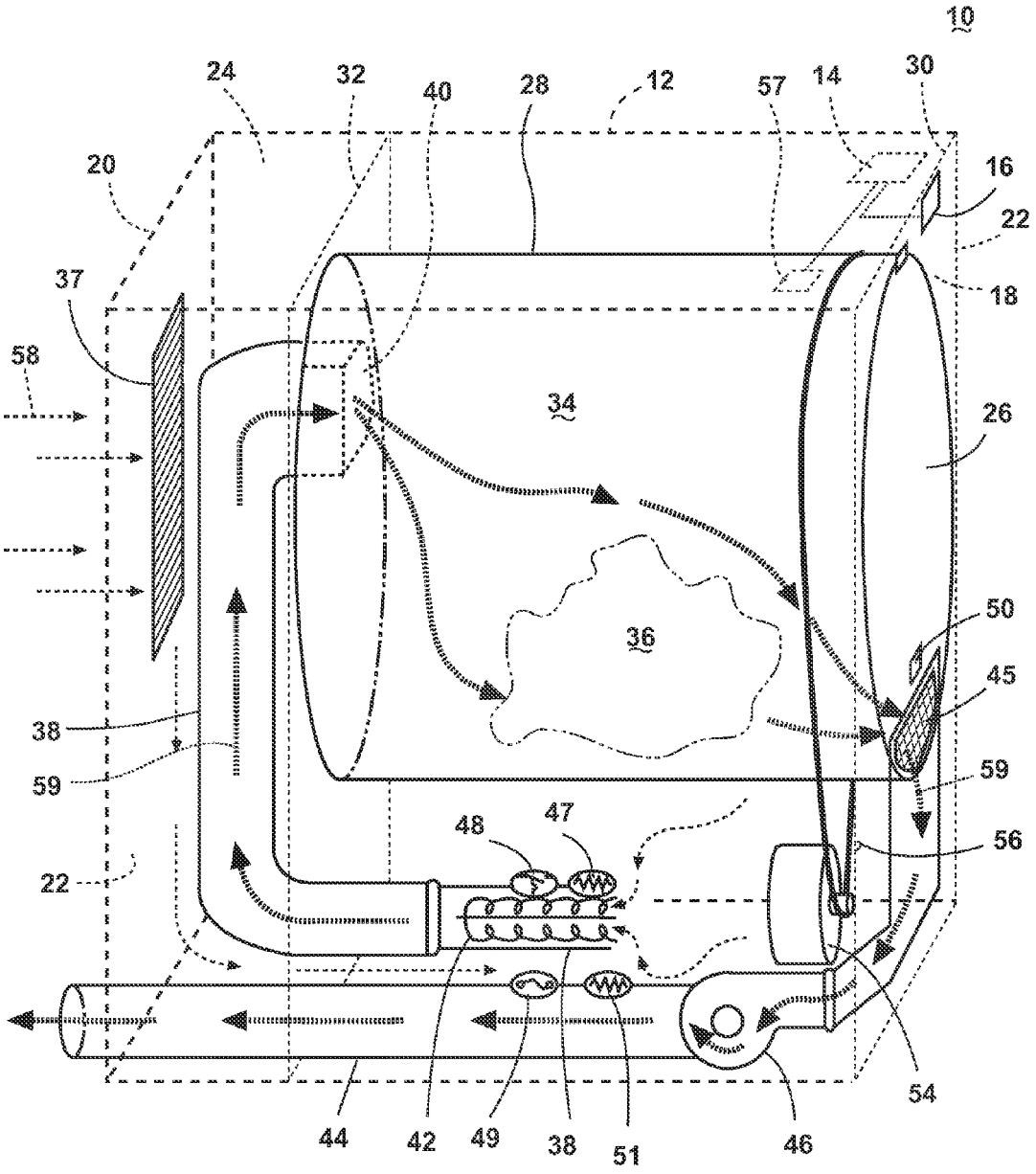
FIG. 1 is a schematic perspective view of a laundry treating appliance in the form of a clothes dryer according to an embodiment of the invention.

FIG. 1 is a schematic view of a laundry treating appliance 10 in the form of a clothes dryer 10 according to a first embodiment of the invention. While the laundry treating appliance is illustrated as a clothes dryer 10, the laundry treating appliance according to the invention may be any appliance which performs a cycle of operation on laundry and uses an electrical heating element that impacts the cycle time when the wattage of the heating element varies during the cycle or from an anticipated wattage, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. The laundry treating appliance according to the invention may also include both an open loop dryer and a closed loop dryer system, for example, a condensing, recirculating, or heat pump dryer. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary rear and front bulkheads 30, 32, which collectively define a treating chamber 34, for treating laundry 36, having an open face that may be selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter (not shown). In most dryers, there may be multiple lifters. The lifters may be located along the inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a drying cycle. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form in part a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct or exhausting the air from the treating chamber 34 to the outside the clothes dryer 10.

The air system may further include various sensor and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining the inlet temperature. A thermistor 51 and thermal fuse 49 may be coupled to the exhaust conduit 44, with the thermistor 51 being used to determine the outlet air temperature. A moisture sensor 50 may be positioned in the interior of the treating chamber 34 to monitor the amount of moisture of the laundry in the treating chamber 34.

A dispenser 57 may be provided to the clothes dryer 10 to dispense a treating chemistry during a drying cycle. As illustrated, the dispenser 57 may be located in the interior of the cabinet 12 such that the treating chemistry may be dispensed, although other locations are also possible. The dispenser 57 may include a reservoir of treating chemistry that is releasably coupled to a dispenser 57, which dispenses the treating chemistry from the reservoir to the treating chamber 34. The treating chemistry may be any type of aid for treating laundry, and non-limiting examples include, but are not limited to fabric softeners, sanitizers, de-wrinklers, and chemicals for imparting desired properties to the laundry, including stain resistance, fragrance (e.g., perfumes), insect repellency, and UV protection.

Figure 2:
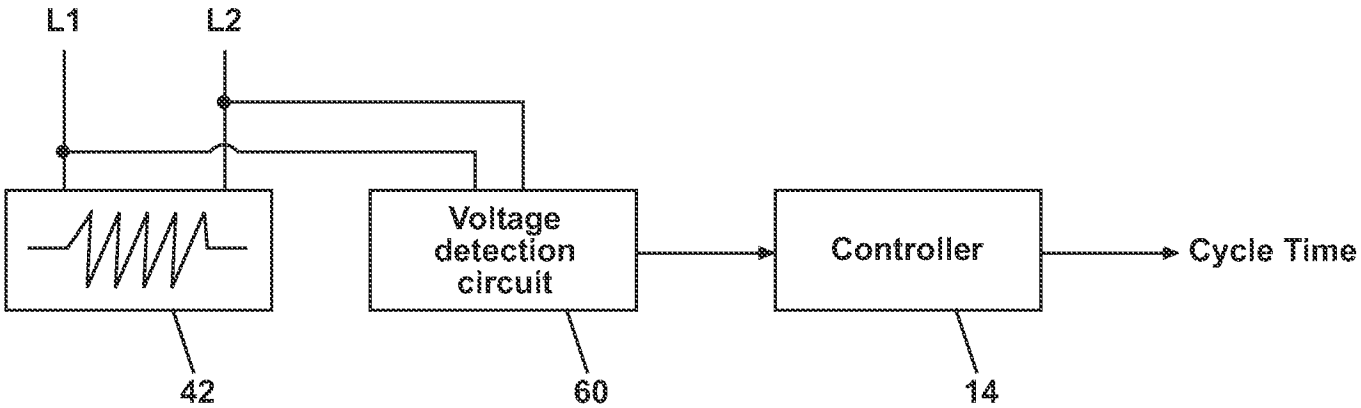
FIG. 2 is a schematic view of a voltage detecting circuit for the clothes dryer of FIG. 1.

FIG. 2 is a schematic view of a voltage detection circuit 60 for the clothes dryer of FIG. 1. The voltage detection circuit 60 may be operably coupled to the heating element 42 and to the controller 14. As illustrated, the voltage and phase angle across the heating element 42 may be detected by the voltage detection circuit that is coupled to two electrical mains (L1, L2), and may be represented as voltage for L1 to L2. It is noted that the voltage may be measured by other methods such as a phase angle method. The voltage determined by the voltage detection circuit 60 may be output to the controller 14, in which the determined voltage may be considered in estimating cycle time. In most cases, the output of the voltage detection circuit is a signal indicative of the voltage across the heating element, which the controller 14 may use as an indicator of the voltage. Any suitable voltage detection circuit may be used. The particular voltage detection circuit is not germane to the invention.

Figure 3:
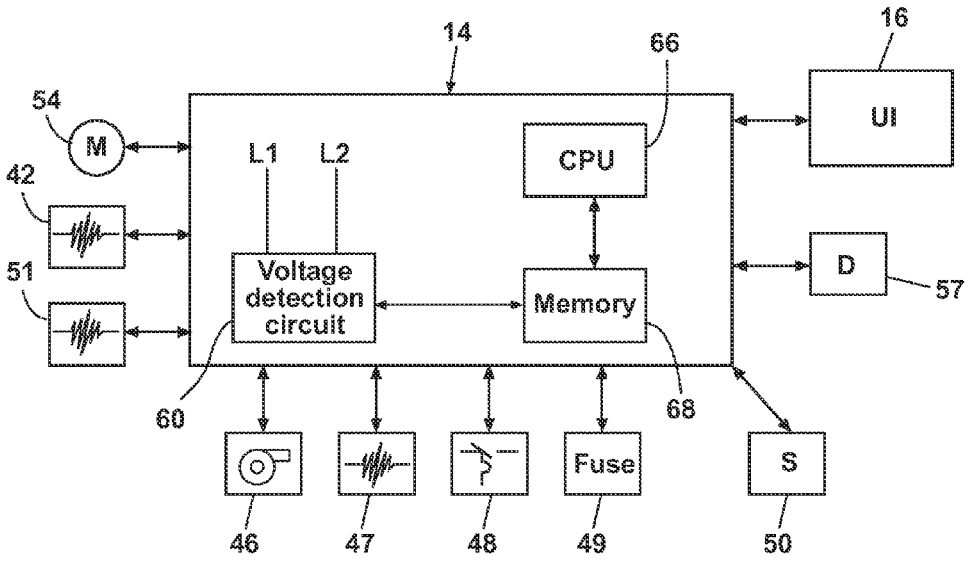
FIG. 3 is a schematic view of a controller of the clothes dryer in FIG. 1.

FIG. 3 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, motor 54, and dispenser 57 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided that has operational controls such as dials, lights, knobs, levers, buttons, switches, and displays enabling the user to input commands to a controller 14 and receive information about a drying cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, Jeans.

The controller 14 may implement a drying cycle selected by the user according to any options selected by the user and provide related information to the user. The controller 14 may also comprise a central processing unit (CPU) 66 and an associated memory 68 where various drying cycles and associated data, such as look-up tables, may be stored. One or more software applications, such as an arrangement of executable commands/instructions may be stored in the memory and executed by the CPU 66 to implement the one or more drying cycles.

In general, the controller will effect a drying cycle of operation to effect a drying of the laundry in the treating chamber 34. The controller 14 will actuate the blower 46, which will draw air into the supply conduit 38 through the rear vent 37. The controller 14 may activate the heating element 42 to heat the inlet air flow as it passes over the heating element 42, with the heated air being supplied to the treating chamber 34. The thermistor 47 may sense the temperature of inlet air that passes through the supply conduit 38 and send to the controller 14 a signal indicative of the sensed temperature. The heated air may be in contact with a laundry load 36 as it passes through the treating chamber 34 on its way to the exhaust conduit 44 to effect a moisture removal of the laundry. The air may exit the treating chamber 34, and flow through blower 46 and the exhaust conduit 44 to the outside the clothes dryer 10. The controller 14 continues the cycle of operation until it is determined that the laundry is dry. The determination of a "dry" load may be made in different ways, but is often based on the moisture content of the laundry, which is typically set by the user based on the selected cycle, an option to the selected cycle, or a user-defined preference.

Figure 4:
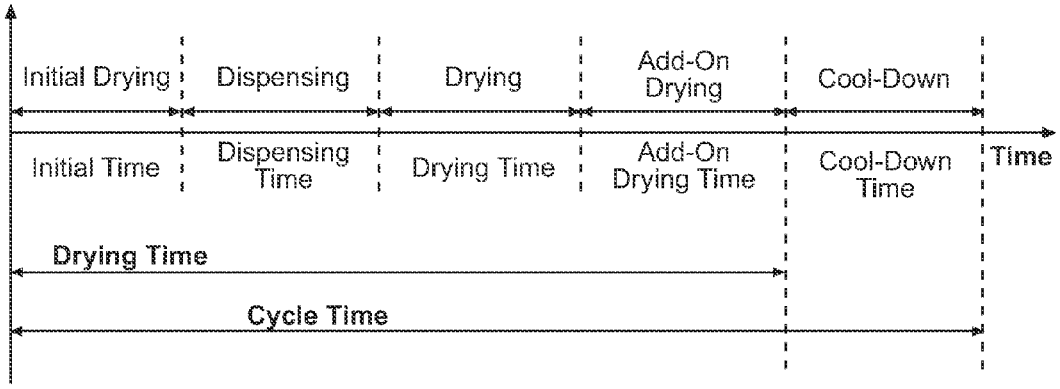
FIG. 4 is a schematic view of a timeline for a drying cycle of operation.

The overall cycle time of a cycle of operation, such as a drying cycle of operation, may comprise many subparts, each of which has their time, with all of them collectively forming the cycle time. FIG. 4 is a schematic view of a timeline for a drying cycle of operation, which may be have subparts or sub-cycles, such as an Initial Drying, Dispensing, Drying, Add-On Drying, and Cool-Down. Each of these phases has a corresponding time, which may or may not be variable as the case may be. The total of these times will be referred to as the cycle time in this application, with it being understood that the cycle time is a function of the time of these phases. Not all of the phases are related to the drying of the laundry. The sum of the phases related to the drying of the laundry will be referred to as the drying time.

A brief summary of these different phases may be helpful in understanding the invention. The Initial Drying phase is normally a predetermined time period, Initial Time, of about five minutes in length. During this time, the moisture sensor 50 has not provided sufficient moisture data for the controller 14 to make an initial estimate of how wet is the laundry. Thus, an initial Cycle Time is selected based on the selected cycle, load size, and other relevant data. The initial Cycle Time is normally taken from a look up table in the memory 68 of the controller 14. This initial Cycle Time is displayed on the user interface 16 and is counted down as time passes.

After the Initial Drying phase is completed, a Drying phase is begun for a Drying Time and the controller 14 may use the moisture data during the Initial Drying phase to determine the Drying Time and update the estimate of the Cycle Time. The updated Cycle Time will necessarily take into account the time that has already lapsed. Thus, the updated Cycle Time may be thought of as a remaining cycle time. The updated Cycle Time is then displayed on the user interface 16. The Cycle Time may be updated any number of times, but it is normally updated only one more time, which coincides with the time at which the moisture sensor 50 no longer can provide useful data, which is about 10% to 15% moisture content for most contemporary conductivity moisture sensors.

The Add-On Drying phase begins at the point where the moisture sensor 50 no longer provides useful data. At this time, the controller 14 will determine how much additional time is needed to dry the laundry, Add-On Drying Time, if any. If no more time is needed, the Cool-Down phase is begun. The Add-On Drying Time is normally based on the moisture data, inlet temperature data, and outlet temperature data during the Drying phase. If a new Cycle Time is warranted, then the Cycle Time will be updated and displayed.

Once the Add-On Drying phase is completed, the cool-down phase is executed for a Cool-Down Time, which, when over, ends the Cycle Time. If need be, the Cycle Time may be updated. The cool-down time may be determined in a preselected manner, for example, by using a "look-up table" or an array of cool down times stored in the controller 14 and based upon selected fabric type, dryness, load size, and the like, or by calculating the cooldown time based on a total calculated dry time and a preselected heater set temperature.

The Initial Time, Dispensing Time, Drying Time, and Add-On Drying Time are sometimes referred to as the drying time because their sum represents the time that the laundry is being dried, which normally coincides with the air being heated. The cumulative time of all five phases represents the Cycle Time. For purposes of this application, the term cycle time is meant to refer to the total time it takes for the cycle of operation to complete, regardless of whether the drying cycle of operation has all four of these phases. The term drying time is meant to refer to the time that the laundry is being dried or relevant drying sub phases, such as the Drying Time, with or without the Initial Time or the Add-On Drying Time.

Determining a cycle time in the clothes dryer 10 is fully set forth in detail in U.S. Pat. No. 7,594,343, issued Sep. 29, 2009, and titled "Drying Mode for Automatic Clothes Dryer", which is incorporated herein by reference in its entirety.

With that background, it may be better appreciated how a change in the thermal output of the heating element impacts the drying time and the cycle time. To date, the various algorithms used to calculate the drying time and cycle time do not take into account the actual output of the heating element during the drying cycle of operation. The current algorithms assume that the heating element provides output at its design specification. However, the thermal output of the electric heating elements may degrade over time and not meet the design specification. Also, if the line voltage supplied to the heating element does not match the specification for the heating element, the heating element will not output the wattage it was designed for.

For an electric heating element, the wattage (power) is greatly impacted by the supplied voltage because the power of the heating element is exponentially related to the voltage as can be seen by equation (1). The power drops as a function of the square of the voltage:

$$P(\text{power wattage}) = \frac{V^2(\text{voltage}^2)}{R(\text{ohm})} \quad (1)$$

It is noted that the most common heating system having a nominal resistance of 9.67 ohm for a clothes dryer may have power capacity of 5400 watts at 240 V. If the voltage in the home was 216 V, which is 10% lower than nominal voltage of 240 V, the heater may supply only 4824 watts, which is only 80% of normal power to heat the air and dry a laundry load in the clothes dryer 10. Thus, a 10% voltage drop results in a 20% power loss in this example, making it clear that a small drop in voltage more greatly impacts the power. For example, a 3 pound load of cotton-towels takes approximately 31.4 minutes to dry at 208 volts and 4680 watts as compared to 28 minutes at 240 volts and 5400 watts. Similarly, a 15 pound load of jeans takes approximately 83.1 minutes to dry at 208 volts and 4680 watts as compared to 70.6 minutes at 240 volts and 5400 watts. As the increase in drying time is generally proportion to the power loss a small voltage drop can substantially increase the drying time and the cycle time. Contemporary algorithms would not take into account the change in power associated with the change in voltage because they assume that the heating element is operating at the design specification. As such, contemporary algorithms would significantly over/under estimate the drying time and cycle time for a corresponding increase/decrease in the actual voltage as compared to the design voltage, which would lead to laundry that is too dry or too wet. A result that is undesirable to the consumer.

Figure 5:
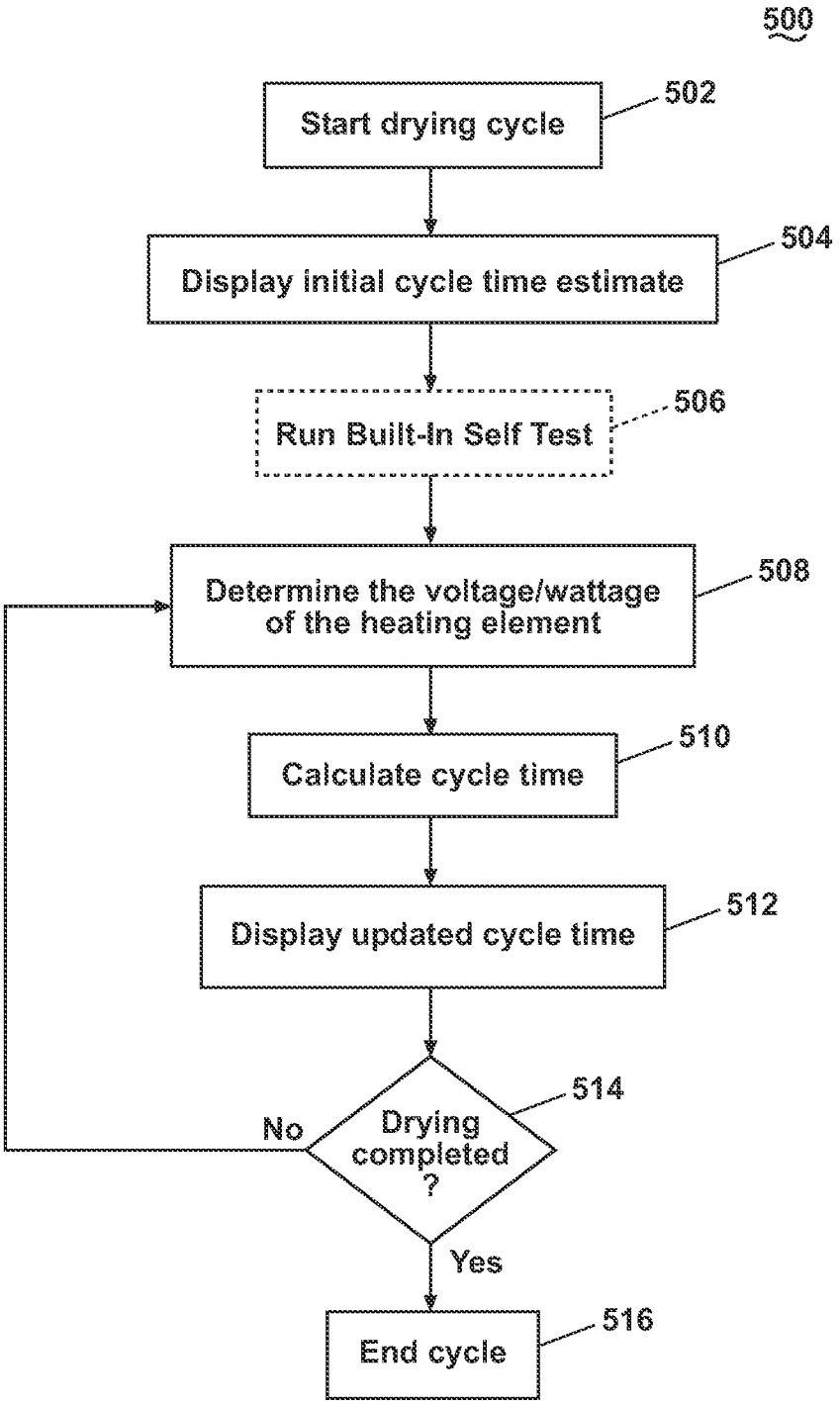
FIG. 5 is a flow chart for operating the clothes dryer according to another embodiment of the invention.

FIG. 5 is a flow chart for operating the clothes dryer 10 according to a second embodiment of the invention. The sequence of steps depicted in FIG. 5 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the clothes dryer 10, such as prior to or as part of any phase of the treatment cycle. The method may also be a stand-alone cycle.

The method 500 may begin at 502 by starting a drying cycle of operation. It is assumed that the drying cycle may be implemented with laundry inside the treating chamber 34. At 504, initial cycle time estimate may be displayed on the user interface 16 to notify the user of the cycle time, such as a remaining cycle time.

The initial cycle time at 504 may be estimated using fuzzy logic or regression analysis methods based on initial inputs such as load size, load fabric type, and initial wetness, or, alternatively, a table look up may be used.

At 506, an optional built-in self test may be implemented using a test circuit coupled to the clothes dryer 10. The self test may be run on a power supply providing electricity to the heating element 42 to detect any wiring fault of the power supply. The power supply for the method 500 may have variable configurations in terms of number of phase and voltage. For example, the power supply may be a three phase power supply having electrical mains (L1, L2) and a neutral line N, while other configurations of power supplies may be also possible.

At 508, a wattage output determination of the heating element 42 is made. The wattage output may be determined by sensing the voltage across the heating element 42 and using that information to determine the wattage output of the heating element 42. The determination may be performed using two electrical mains (L1, L2) coupled to the heating element 42, and the voltage detection circuit 60, as shown in FIG. 2. The wattage determining may be configured to implement after passage of a predetermined time once a drying cycle begins.

At 510, the cycle time may be calculated in consideration of the wattage determined at 508. Other inputs may be used for the cycle time determination, such as dry weight of the laundry load, wet weight of the laundry load, moisture content of the laundry load, and fabric type of the laundry load. These inputs, if any, along with the wattage will be used by the controller 14 to calculate the cycle time. The cycle time calculated at 510 may be different than the initial cycle time estimated at 504. For example, new cycle time may be longer or shorter than the initial cycle time, depending on the difference between initial voltage and wattage input provided at 504, and voltage and wattage determined at 508.

At 512, the updated cycle time may be displayed on the user interface 16 to provide a user with more accurate, updated cycle time such as a remaining cycle time.

At 514, it may be determined if the drying cycle may complete. The determination may be made based on various parameters such as the moisture content of laundry or temperature of outlet air flow. For example, if the moisture content is equal to or less than a predetermined threshold, the drying cycle may be considered to be complete, and a cycle of operation may end at 516. If the drying cycle may not satisfy threshold, and a drying cycle is determined not complete, the method may return to 508 to re-calculate updated cycle time through 512 until it is determined that drying cycle completes. Under this condition, it is noted that the method may return to 506 and the self test may be run prior to determining the voltage and wattage of the heating element 42 while the method may return to 508 with running self test only once.

The method 500 may be based on repeated testing of voltage and wattage of heating element 42 until drying time completes. In another embodiment, the test may be implemented only once during a drying cycle assuming that the voltage and wattage across the heating element 42 may be consistent and may not vary more than a predetermined range during a whole drying cycle.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a clothes dryer comprising a treating chamber for receiving a laundry load for drying, an air system for supplying and exhausting air from the treating chamber, a heating element for heating the air supplied to the treating chamber, and a controller implementing a cycle of operation having a cycle time, the method comprising:

a) sensing a wattage of the heating element during the implementation of the cycle of operation;

b) providing the sensed wattage as input to the controller; and c) wherein the controller updates the cycle time based on at least the sensed wattage.

2. The method of claim 1 wherein the sensing of the wattage comprises sensing a voltage applied to the heating element.

3. The method of claim 2 wherein the sensing the voltage applied to the heating element comprises sensing the voltage between electrical mains supplying electricity to the heating element.

4. The method of claim 3 wherein the inputting the sensed wattage to the controller comprises inputting the sensed voltage to the controller.

5. The method of claim 4 wherein the inputting the sensed voltage to the controller comprises providing a signal indicative of the sensed voltage to the controller.

6. The method of claim 2 wherein the updating the cycle time comprises setting a remaining cycle time.

7. The method of claim 6 further comprising repeatedly setting the remaining cycle time during the implementation of the cycle of operation.

8. The method of claim 7 wherein the repeatedly setting the remaining cycle time comprises repeatedly sensing the wattage and repeatedly determining the remaining cycle time for each repeated sensing of the wattage.

9. The method of claim 1 wherein updating the cycle time comprises setting a drying time portion of the cycle time.

10. The method of claim 9 wherein setting the cycle time further comprises adding at least one of final dry time and cool down time to the drying time.

11. The method of claim 1 further comprising determining at least one physical characteristic of the laundry load in the treating chamber, inputting the at least one physical characteristic to the controller, wherein the controller generates the updated cycle time based on at least the sensed wattage and the at least one physical characteristic.

12. The method of claim 11 wherein the determining the at least one physical characteristic comprises sensing the at least one physical characteristic.

13. The method of claim 11 wherein the determining the at least one physical characteristic comprises receiving the at least one physical characteristic as input from a user.

14. The method of claim 11 wherein the at least one physical characteristic of the laundry load comprises at least one of: dry weight of the laundry load, wet weight of the laundry load, moisture content of the laundry load, and fabric type of the laundry load.

15. The method of claim 1 further comprising running an electrical self-test on a power supply providing electricity to the heating element for a wiring fault of the power supply.

16. The method of claim 15 wherein the running of the self-test is conducted prior to the sensing of the wattage applied to the heating element.

17. The method of claim 16 wherein the self-test is run a predetermined number of times.

18. The method of claim 15 wherein when the power supply is a three phase power supply having electrical mains (L1, L2) and a neutral line N, the testing comprises determining voltages for L1, L2 and L1 to L2, and comparing the voltages.

19. The method of claim 15 wherein the self-test generates fault data indicative of a fault condition that is received as input by the controller to alter the operation of the clothes dryer for the fault condition.

20. The method of claim 1 wherein the updating the cycle time further comprises the controller estimating the cycle time based on at least the sensed wattage.

21. The method of claim 20, further comprising displaying the estimate of the cycle time on a user interface of the clothes dryer.

* * * * *